US009046099B2

(12) United States Patent
Skrynski

(10) Patent No.: US 9,046,099 B2
(45) Date of Patent: Jun. 2, 2015

(54) DELIVERY UNIT

(75) Inventor: Evgenij Skrynski, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 85 days.

(21) Appl. No.: 13/823,727

(22) PCT Filed: Jul. 26, 2011

(86) PCT No.: PCT/EP2011/062798

§ 371 (c)(1),
(2), (4) Date: Mar. 14, 2013

(87) PCT Pub. No.: WO2012/034759

PCT Pub. Date: Mar. 22, 2012

(65) Prior Publication Data

US 2013/0189142 A1 Jul. 25, 2013

(30) Foreign Application Priority Data

Sep. 14, 2010 (DE) ..... 10 2010 040 758

(51) Int. Cl.
*F04C 2/00* (2006.01)
*F04C 3/08* (2006.01)
*F04C 15/06* (2006.01)

(52) U.S. Cl.
CPC ... *F04C 2/00* (2013.01); *F04C 3/08* (2013.01); *F04C 2240/603* (2013.01); *F04C 15/062* (2013.01)

(58) Field of Classification Search
CPC ..... F04C 3/08; F04C 2/00; F04C 15/062; F04C 2240/603; F04C 15/06; F04C 29/023; F04C 15/0088; F04C 15/0038; F04C 3/02; F04C 3/06; F04C 9/005; F04C 18/52; F01C 3/06; F01C 9/005
USPC ..... 418/49, 94, 102, 195, 68
See application file for complete search history.

(56) References Cited

U.S. PATENT DOCUMENTS

| | | | | |
|---|---|---|---|---|
| 2,831,436 | A * | 4/1958 | Schmidt et al. | 418/195 |
| 3,964,842 | A * | 6/1976 | White, Jr. | 418/15 |
| 2005/0271523 | A1 * | 12/2005 | Kawakami et al. | 417/269 |
| 2010/0104462 | A1 * | 4/2010 | Arnold et al. | 418/142 |

FOREIGN PATENT DOCUMENTS

| | | |
|---|---|---|
| DE | 102008013991 | 12/2008 |
| EP | 1544466 | 6/2005 |
| WO | 03055551 | 7/2003 |

OTHER PUBLICATIONS

International Search Report for Application No. PCT/EP2011/062798 dated Feb. 6, 2013 (3 pages).

* cited by examiner

*Primary Examiner* — Mary A Davis
*Assistant Examiner* — Jason T Newton
(74) *Attorney, Agent, or Firm* — Michael Best & Friedrich LLP

(57) ABSTRACT

A delivery unit is already known, which comprises a drive shaft and a rotor driven by the drive shaft. The rotor is rotatably arranged in a stator housing, wherein the rotor has a toothing on the end face of said rotor that is remote from the drive shaft, wherein said toothing meshes with a toothing constructed on the stator housing. The drive shaft comprises an oblique sliding plane interacting with the rotor and which is constructed on a shoulder of the drive shaft and allows the rotor to gyrate with the rotor axis thereof about the drive axis of the drive shaft. Work spaces are formed between the toothing of the rotor and the toothing of the stator housing, wherein said work spaces can be filled via an inlet and emptied via an outlet. In one embodiment the fluid is admitted axially and discharged radially, and in the other embodiment the fluid is admitted and discharged axially. For that purpose, control valves in the form of non-return valves are required. The non-return valves cause additional internal leakages, resulting in a reduction in the volumetric efficiency of the pump. The valves are additional parts, which are associated with additional costs and an increased risk of failure. In the delivery unit according to the invention the control valves can be dispensed with. According to the invention the inlet (15) is provided in a channel (20) of the drive shaft (2) and the outlet (16) is provided at the shoulder (6) of the drive shaft (2).

6 Claims, 2 Drawing Sheets

DELIVERY UNIT

BACKGROUND OF THE INVENTION

The invention proceeds from a delivery unit according to the generic type.

DE 10 2008 013 991 A1 has already disclosed a delivery unit, having a drive shaft and a rotor which is driven by the drive shaft and is arranged rotatably in a stator housing, the rotor having a toothing system on its end side which faces away from the drive shaft, which toothing system meshes with a toothing system which is formed on the stator housing, the drive shaft having an oblique sliding plane which interacts with the rotor, is formed on a shoulder of the drive shaft and allows the rotor to tumble with its rotor axis about the drive axis of the drive shaft, working spaces being formed between the toothing system of the rotor and the toothing system of the stator housing, which working spaces can be filled via an inflow and can be emptied via an outflow.

In the first exemplary embodiment, the fluid is fed in axially and is discharged radially. In the second exemplary embodiment, the fluid is fed in and discharged axially. To this end, control valves in the form of nonreturn valves are required. The nonreturn valves cause additional inner leaks, which results in a reduction in the degree of volumetric efficiency of the pump. The valves are additional parts which are associated with additional costs and an increased risk of failure.

SUMMARY OF THE INVENTION

In contrast, the delivery unit according to the invention having the characterizing features of the main claim has the advantage that the control valves can be dispensed with, by the inflow being provided in a channel of the drive shaft and the outflow being provided on the shoulder of the drive shaft, or vice versa.

It is very advantageous if the inflow and outflow are positioned in the sliding plane, the inflow being arranged in one section and the outflow being arranged in the other section of the oblique sliding plane. A defined pressure level can be set by the shaping of the surfaces of inflow and outflow on the sliding plane. A desired pressure/force balance can therefore also be achieved in the pump.

BRIEF DESCRIPTION OF THE DRAWINGS

One exemplary embodiment of the invention is shown in simplified form in the drawing and is explained in greater detail in the following description.

DETAILED DESCRIPTION

Figure 1:
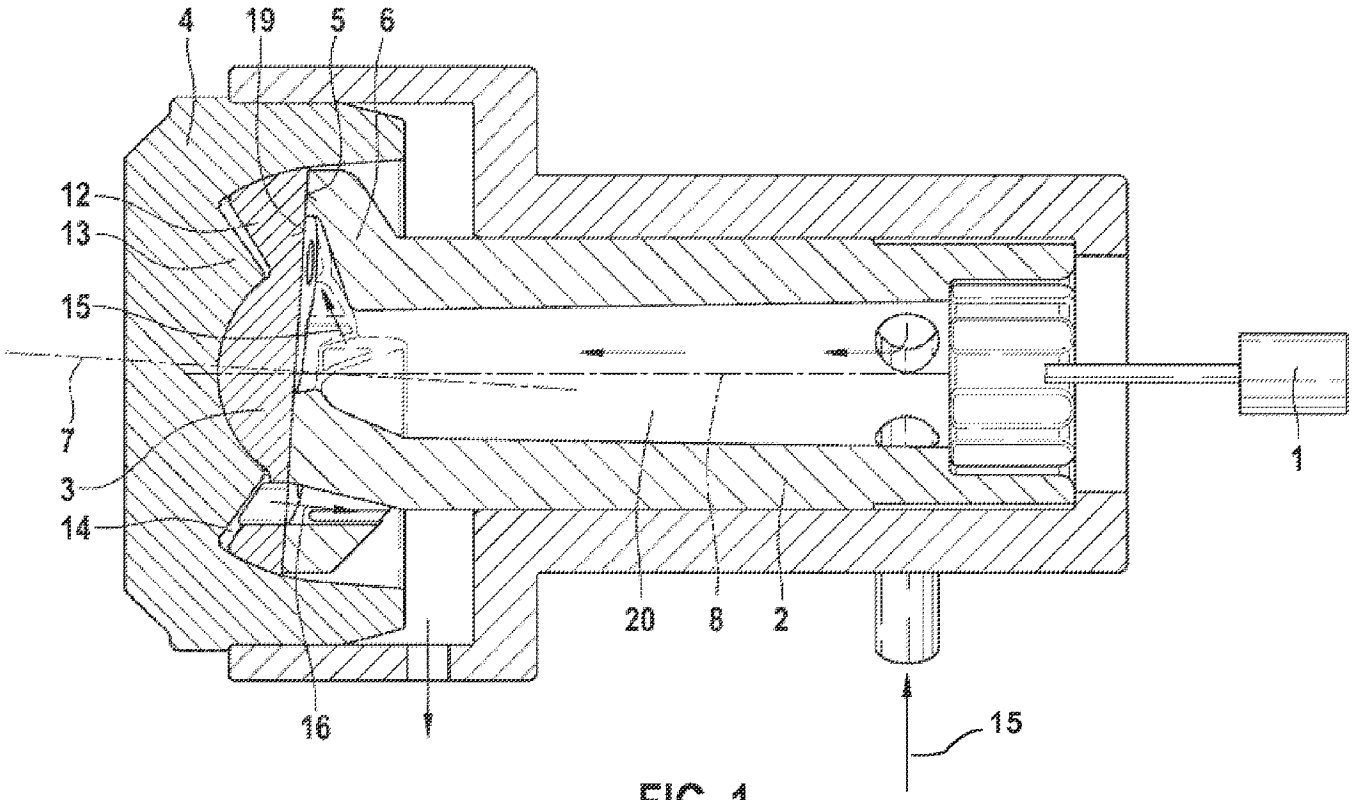
FIG. 1 shows a delivery unit according to the invention in section.

FIG. 1 shows a delivery unit according to the invention in section.

The delivery unit, for example a pump or a compressor, comprises a drive shaft 2 which is driven by an actuator 1. The drive shaft 2 drives a rotor 3 which is arranged rotatably in a stator housing 4. The drive shaft 2 has an oblique sliding plane 5 which interacts with the rotor 3, is formed on a shoulder 6 of the drive shaft 2 and allows the rotor 3 to tumble with its rotor axis 7 about the drive axis 8 of the drive shaft 2. On its end side which faces away from the drive shaft 2, the rotor 3 has a toothing system 12 which meshes with a toothing system 13 which is formed on the stator housing 4, working spaces 14 being formed between the toothing system 12 of the rotor 3 and the toothing system 13 of the stator housing 4, which working spaces 14 can be filled via an inflow 15 and can be emptied via an outflow 16. The inflow 15 and the outflow 16 contain control edges 24, 25 which define the switch-on instants of the working spaces 14. As a result, retarded or premature emptying of the working spaces can be achieved.

The toothing system 12 of the rotor 3 and the toothing system 13 of the stator housing 4 have a different number of teeth.

The delivery unit operates according to the displacement principle, with the result that fluid is sucked regeneratively into the working spaces 14 and is ejected from the latter at an increased pressure. On its side which faces the drive shaft 2, the rotor 3 has a sliding face 19 which interacts with the oblique sliding plane 5 and, on its side which faces the toothing system 13 of the stator housing 4, said rotor 3 has the toothing system 12. The toothing system 12 of the rotor 3 and the toothing system 13 of the stator housing 4 are, for example, in each case a cycloidal toothing system, but can also be a different toothing system. As an alternative, the toothing systems 12, 13 can also be of helical or spiral configuration.

It is provided according to the invention that the inflow 15 is provided in a channel 20 of the drive shaft 2 and the outflow 16 is provided as a through opening on the shoulder 6 of the drive shaft 2. Conversely, the outflow 16 can be provided in a channel 20 of the drive shaft 2 and the inflow 15 can be provided as a through opening on the shoulder 6 of the drive shaft 2. According to the exemplary embodiment, the channel 20 runs at least in sections parallel to the drive axis 8, but can also expressly be of different configuration.

The outflow 16 can be, for example, of arcuate configuration and can comprise a plurality of outflow openings which are arranged arcuately. The channel 20 opens into the oblique sliding plane 5 via an inflow 15 which is configured as a recess 22. The recess 22 is widened, for example, with respect to the cross section of the channel 20. According to the exemplary embodiment according to FIG. 2, the recess 22 is of semicircular configuration. In order to fill the working spaces 14, the rotor 3 has through openings 23 in the troughs of the toothing system 12, which through openings 23 lead to the sliding face 19 on the other side. In this way, the filling of the working spaces 14 can take place via the channel 20, the recess 22 and the through openings 23, and the emptying can take place via the through openings 23 and the outflow 16.

The oblique sliding plane 5 comprises a surface which is, for example, of circular configuration, the inflow 15 being arranged in a section, for example of the one circle half, and the outflow 16 being arranged in the other section, for example of the other circle half of the oblique sliding plane 5. The inflow 15 and the outflow 16 are arranged next to one another and spaced apart from one another in the oblique sliding plane 5. At least one separating web 21 is provided between the inflow 15 and the outflow 16, with the result that the inflow 15 and the outflow 16 are separated sealingly from one another.

The stator housing 4 can also be configured as a rotating component. Thus, the shaft with control openings becomes a stationary part and the stator becomes a rotating part.

Flow can pass through the delivery unit in both directions, that is to say the inflow 15 can also be an outflow and the outflow 16 can also be an inflow.

Figure 2:
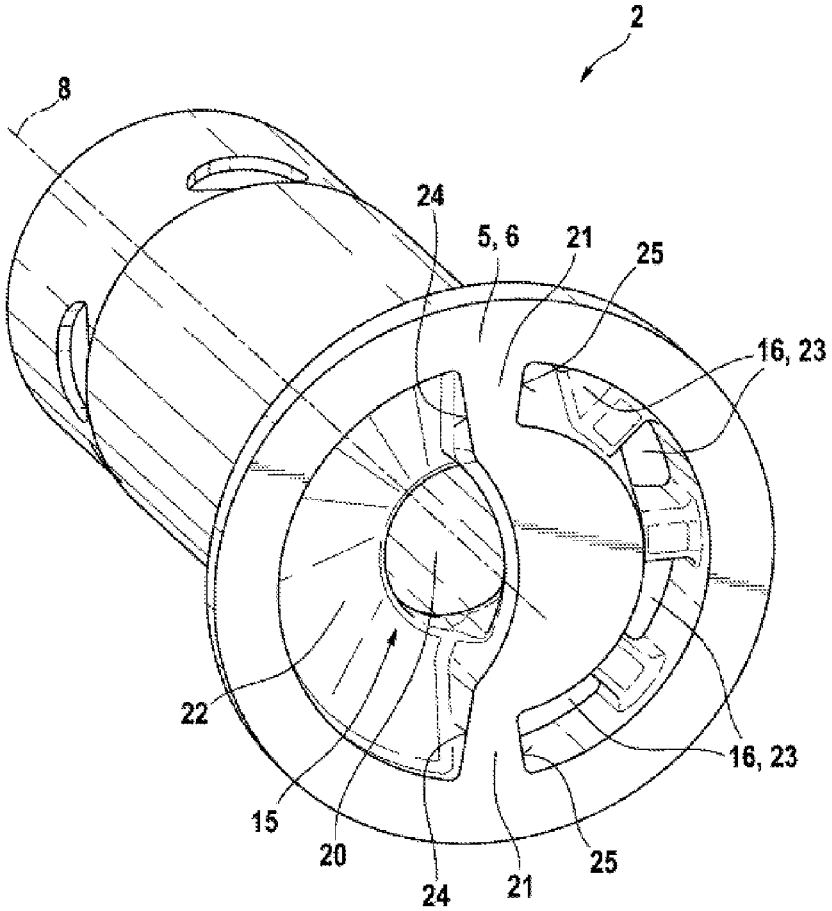
FIG. 2 shows a drive shaft according to the invention of the delivery unit according to FIG. 1.

FIG. 2 shows a drive shaft according to the invention of the delivery unit according to FIG. 1.

In the view according to FIG. 2, the parts which remain the same or have the same action with respect to the view according to FIG. 1 are labeled by the same designations.

What is claimed is:

1. A delivery unit having a drive shaft (2) and a rotor (3) which is driven by the drive shaft (2) and is arranged rotatably in a stator housing (4), the drive shaft (2) having an oblique sliding piano (5) which interacts with the rotor (3), is formed on a shoulder (6) of the drive shaft (2) and allows the rotor (3) to tumble with a rotor axis (7) about a drive axis (8) of the drive shaft (2), the rotor (3) having a toothing system (12) on an end side which faces away from the drive shaft (2), which toothing system (12) meshes with a toothing system (13) which is formed on the stator housing (4), working spaces (1.4) being formed between the toothing system (12) of the rotor (3) and the toothing system (13) of the stator housing (4), which working spaces (14) can be filled via an inflow (15) and can be emptied via an outflow (16), characterized in that one of the inflow (15) and the outflow is provided in a channel (20) of the drive shaft (2) and the other of the inflow and the outflow (16) is provided on the shoulder (6) of the drive shaft (2), characterized in that the outflow (16) is of arcuate configuration or includes a plurality of outflow openings which are arranged arcuately, characterized in that the oblique sliding plane (5) is of circular configuration, the inflow (15) being arranged in one circle half and the outflow (16) being arranged in another circle half of the oblique sliding plane (5), and characterized in that at least one separating web (21) is provided between the inflow (15) and the outflow (16).

2. The delivery unit as claimed in claim 1, characterized in that the inflow (15) and the outflow (16) are formed in the oblique sliding plane (5) of the drive shaft (2).

3. The delivery unit as claimed in claim 1, characterized in that the inflow (15) and the outflow (16) are arranged next to one another in the oblique sliding plane (5).

4. The delivery unit as claimed in claim 1, characterized in that the channel (20) opens into the oblique sliding plane (5) via a semicircular recess (22).

5. The delivery unit as claimed in claim characterized in that the rotor (3) has a sliding face (19) which interacts with the oblique sliding plane (5) on one side and has the toothing system (12) on an other side.

6. The delivery unit as claimed in claim 1, characterized in that, the rotor (3) has, in troughs of the toothily, system (12), through openings (23) to an other side.

* * * * *